United States Patent [19]

Farrar et al.

[11] Patent Number: 5,024,786

[45] Date of Patent: Jun. 18, 1991

[54] DETERGENT COMPOSITIONS CONTAINING AN ANIONIC SURFACTANT AND A 4,4'-BIS(TRIAZINYLAMINO)-STILBENE DISULPHONIC ACID OPTICAL BRIGHTENER

[75] Inventors: John M. Farrar, Rawdon; Mark D. Graham, Horsforth, both of Great Britain

[73] Assignee: Sandoz Ltd., Basel, Switzerland

[21] Appl. No.: 263,665

[22] Filed: Oct. 27, 1988

[30] Foreign Application Priority Data

| | | | |
|---|---|---|---|
| Oct. 30, 1987 | [GB] | United Kingdom | 8725537 |
| Feb. 4, 1988 | [GB] | United Kingdom | 8802513 |
| Jun. 7, 1988 | [GB] | United Kingdom | 8813415 |

[51] Int. Cl.[5] ..... C11D 3/42; C11D 3/28; C11D 3/34

[52] U.S. Cl. ..... 252/543; 252/551; 252/524; 252/301.23; 252/558; 252/DIG. 14

[58] Field of Search ..... 252/524, 543, 550, 551, 252/558, 301.23, DIG. 14

[56] References Cited

U.S. PATENT DOCUMENTS

| | | | |
|---|---|---|---|
| 3,423,407 | 1/1969 | Strobel et al. | 252/543 |
| 3,632,491 | 1/1972 | Zussman et al. | 252/524 |
| 3,700,601 | 10/1972 | Bloching | 252/105 |
| 3,726,814 | 4/1973 | Lancz | 252/543 |
| 3,743,602 | 7/1973 | Ohkawa et al. | 252/110 |
| 3,895,009 | 7/1975 | Fringeli | 252/543 |
| 4,202,800 | 5/1980 | Ciko et al. | 252/543 |
| 4,233,167 | 11/1980 | Sramek | 252/8.75 |
| 4,483,779 | 11/1984 | Llenado | 252/135 |
| 4,559,169 | 12/1985 | Wevers et al. | 252/543 |
| 4,717,502 | 1/1988 | Schmid | 252/301.23 |
| 4,946,628 | 8/1990 | Schüssler et al. | 252/543 |

FOREIGN PATENT DOCUMENTS

| | | |
|---|---|---|
| 49010 | 12/1974 | Japan . |
| 2028365 | 3/1980 | United Kingdom . |
| 2187749 | 9/1987 | United Kingdom . |

*Primary Examiner*—Paul Lieberman
*Assistant Examiner*—Erin M. Higgins
*Attorney, Agent, or Firm*—Gerald D. Sharkin; Richard E. Vila; Thomas C. Doyle

[57] ABSTRACT

An aqueous, isotropic liquid detergent composition comprising an aqueous solution of:

a) an anionic surfactant; and b) an optical brightener of formula I

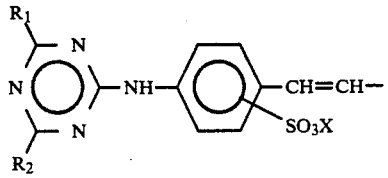

(I)

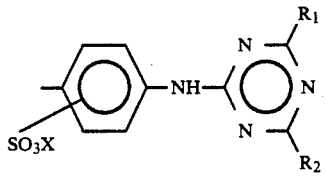

in which X is hydrogen, $NH_4^{\oplus}$, or a cation of an alkali metal, an alkaline earth metal or an organic amine;

$R_1$ is selected from morpholino or anilino unsubstituted or substituted by 1, 2 or 3 groups selected from $C_{1-4}$alkyl, $C_{1-4}$alkoxy and halogen; piperidinyl, unsubstituted or substituted by 1 or 2 $C_{1-4}$alkyl groups; hexamethyleneimino, pyrrolidino, $C_{1-8}$alkylamino; $C_{1-8}$dialkylamino; or a 2,2,6,6-tetramethylpiperidinyl residue;

$R_2$ has a significance of $R_1$ independently of $R_1$;

provided that when both groups $R_1$ (or $R_2$) are morpholino or unsubstituted anilino, the other groups $R_2$ (or $R_1$ respectively), are not both unsubstituted anilino.

27 Claims, No Drawings

DETERGENT COMPOSITIONS CONTAINING AN ANIONIC SURFACTANT AND A 4,4'-BIS(TRIAZINYLAMINO)-STILBENE DISULPHONIC ACID OPTICAL BRIGHTENER

The invention relates to stilbene derivatives for use in detergent compositions.

According to the invention, there is provided an aqueous, isotropic, liquid detergent composition comprising an aqueous solution of (a) an anionic surfactant; and (b) an optical brightener of formula I

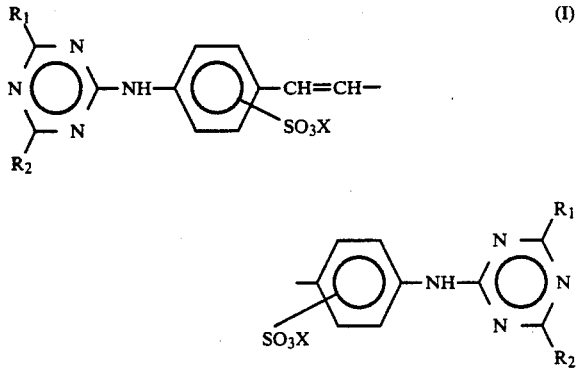

(I)

in which X is hydrogen, $NH_4^+$, or a cation of an alkali metal, an alkaline earth metal or an organic amine;

$R_1$ is selected from morpholino or anilino unsubstituted or substituted by 1, 2 or 3 groups selected from $C_{1-4}$alkyl, $C_{1-4}$alkoxy and halogen; piperidinyl, unsubstituted or substituted by 1 or 2 $C_{1-4}$alkyl groups; hexamethyleneimino, pyrrolidino, $C_{1-8}$alkylamino; di($C_{1-8}$alkyl)amino; or a 2,2,6,6-tetramethylpiperidinyl residue;

$R_2$ has a significance of $R_1$ independently of $R_1$;

provided that when both groups $R_1$ (or $R_2$) are morpholino or unsubstituted anilino, the other groups $R_2$ (or $R_1$ respectively), are not both unsubstituted anilino.

Preferably a composition according to the invention is phosphate-free.

Preferably 2 to 60%, more preferably 5 to 40%, of anionic surfactant is present in a composition according to the invention.

Preferably 0.05 to 1.5%, more preferably 0.1 to 1%, of optical brightener is present in a composition according to the invention.

Preferably a composition according to the invention may also contain builders. Preferred builders are those described in British Patent Application No. 2,187,749A (the content and preferences of which are incorporated herein by reference).

Preferably a composition according to the invention contains an enzyme. Preferably when enzyme is present in a composition according to the invention, it is present in an amount of 0.05–2% by weight. Preferred enzymes are proteases, amylases, lipases, glucose-oxidases, cellulases, more preferably Marcatase enzyme and Termarnyl enzyme.

Preferably a composition according to the invention contains a sequestrant for metal ions (which may be present in water used in a washing process in which a composition according to the invention is used). Preferably when sequestrant, is present, it is present in an amount of 0.1 to 3% by weight, more preferably 0.4 to 1.2%. Preferred sequestrants are alkylene polyaminopolyalkylene polycarboxylic acids and/or polyphosphonic acids, especially diethylene triamine pentaacetic acid; triethylene tetraamine hexaacetic acid and tetraethylene pentamine heptaacetic acid.

Preferably a composition according to the invention contains a performance booster. The preferred amount of performance booster when present is 0.5 to 5% of composition. Preferred performance boosters include ethoxylated amines, more preferably tetraethylene pentamine, preferably ethoxylated with 15 to 19 moles of ethylene oxide.

Preferred anionic surfactants are $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation, $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-($C_2H_5$—O—)$_{1\ to\ 4}$ ether sulphates; $C_{10-20}$alkyl ($C_2H_5$—O—)$_{1\ to\ 4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

Preferably a composition according to the invention contains a non-ionic surfactant. Preferably the amount of non-ionic surfactant when present is 5–20% by weight, provided the total amount of surfactant in the composition is not more than 60%. Preferred non-ionic surfactants are described in British Patent Application No. 2,187,749.

Preferably a composition according to the invention may include a cationic surface active agent. Among cationic surfactants are for example, quaternary ammonium, amine or amine oxide surfactants. Preferred cationic surface active agents are those described in British Patent Application No. 2,187,749. Preferably the amount of cationic surfactant, when present is 5 to 20%, provided the total amount of surfactant is not more than 60%.

The contents and preferences of British Patent Application No. 2,187,749 are incorporated herein by reference.

Compositions according to the invention can also contain other surfactants known in the art such as non-ionic, cationic, zwitterionic and ampholytic surfactants. Preferably the total amount of surfactant is from 15% to 60% inclusive, more preferably from 20 to 45% inclusive. Suitable examples of these optional surfactants are described in U.S. Pat. Nos. 4,285,841 and 3,929,678.

Compositions according to the invention may also contain other additives such as a $C_{10-22}$alkyl or alkenyl fatty acid, the carboxy groups of which may be ethoxylated by 1 to 10 ethylene oxide units. Such additives are preferably present in an amount of from 3 to 30% by weight of the composition.

Preferred fatty acids are selected from coconut fatty acid and oleic acid, more preferably topped whole cut coconut fatty acid and oleic acid.

Preferably when an acid is present in a composition according to the invention, a base to neutralise the acid is also present. Preferably such a base is an ethanolamine, for example N-methylethanolamine.

Preferred 2,2,6,6-tetramethylpiperidine residues include

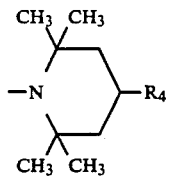

where $R_4$ is —OH or —$NH_2$ or esters or amides thereof or

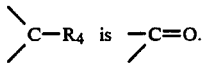

Preferably both $SO_3X$ groups are in 2-position with respect to the ethene (—CH=CH—) group.

Preferably both groups $R_1$ are the same.

Preferably at least one of the groups $R_1$ is piperidinyl, unsubstituted or substituted by 1 or 2 $C_{1-4}$alkyl groups.

Preferably $R_1$ is $R_1'$ where $R_1'$ is anilino, unsubstituted or monosubstituted by $C_{1-4}$alkyl; piperidinyl, unsubstituted or substituted by 1 or 2 $C_{1-4}$alkyl groups; hexamethyleneimino; pyrrolidino, propylamino or dipropylamino. More preferably $R_1$ is $R_1''$ where $R_1''$ is piperidinyl unsubstituted or mono- or di-substituted by $C_{1-4}$alkyl (preferably $CH_3$).

Preferably $R_2$ is $R_2'$ where $R_2''$ is anilino, unsubstituted or substituted by one or two groups selected from halogen (preferably Cl), $C_{1-4}$alkyl (preferably $CH_3$) and $C_{1-4}$alkoxy (preferably $OCH_3$).

In this Specification any halogen is fluoro, chloro, bromo or iodo, preferably chloro or bromo, more preferably chloro.

perfumes and other brighteners known in the art. Such components are generally present in total as no more than 15%, preferably 2 to 12%.

One of the disadvantages of liquid detergent compositions containing stilbene optical brighteners is their inability to produce both excellent build-up and good resistance to brightener staining. Brighteners deposit onto fabrics where they absorb U.V. radiant energy and re-emit it as a blue light. This reduces or eliminates any yellowish cast to fabrics and gives them a bright appearance. However, undesirable brightener staining can occur when liquid detergents come into direct contact with cotton-containing fabrics, such as during pre-treatment. The present invention reduces or eliminates such staining while maintaining an acceptable level of fabric brightening. This good balance of properties is surprising. For example detergent compositions containing a compound of formula I where $R_1$ is unsubstituted anilino and $R_2$ is 4-sulpho anilino (as the optical brightener) show poor resistance to brightener staining whilst having a good build up. On the other hand for example detergent compositions containing compounds of formula I where $R_1$ is methoxy and $R_2$ is —O—$C_6H_5$ show good resistance to brightener staining but have a very poor build up.

Advantages of the detergent compositions according to the invention include good build up and good resistance to brightener staining.

In this Specification, where a symbol appears more than once in a formula, its significances are independent of one another unless indicated to the contrary.

All percentages given in this Specification are by weight of the composition unless indicated otherwise.

EXAMPLE 1

The compound of formula 1*a*

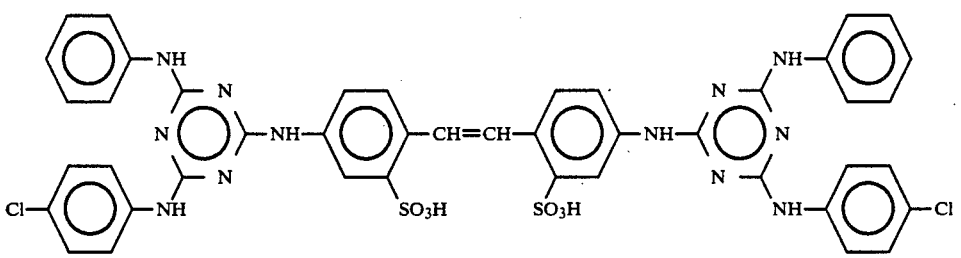

(1a)

Preferably any $C_{1-4}$alkyl group is methyl or ethyl, more preferably methyl.

Preferably any $C_{1-4}$alkoxy is methoxy or ethoxy, more preferably ethoxy.

Preferably X is X' where X' is hydrogen, Na⊕, K⊕ or $NH_4$⊕.

Most preferably each $R_1$ is $R_1'''$ where $R_1'''$ is piperidinyl, unsubstituted or substituted by 1 or 2 methyl groups and each $R_2$ is $R_2''$ where $R_2''$ anilino unsubstituted or mono-substituted by methyl.

Preferably any piperidinyl group as $R_1$ or $R_2$ is attached to the triazinyl group through the heterocyclic N-atom.

Compounds of formula I are known and may be made from known compounds by known methods.

Preferably the composition according to the invention is a liquid laundry detergent composition.

Compositions according to the invention may also include enzyme stabilising agents, polyacids, soil removal agents, antiredeposition agents, sud regulants, hydrotropes, opacifiers, antioxidants, bactericides, dyes, in sodium salt form; is added to the following composition:

7.2% of $C_{13}$ linear alkylbenzene sulphonic acid
10.8% of $C_{14-15}$alkyl polyethoxylate (2.25) sulphuric acid
6.5% of $C_{12-13}$alcohol polyethoxylate (6.5)*
Alcohol and monoethoxylated alcohol removed.
1.2% of $C_{12}$alkyl trimethylammonium chloride
13.0% of $C_{12-14}$fatty acid
2.0% of oleic acid
4.0% of citric acid (anhydrous)
0.23% of diethylenetriamine pentaacetic acid
1.5% of TEPA-$E_{15-18}$**
Tetraethylene pentamine ethoxylated with 15-18 moles (avg) of ethylene oxide at each hydrogen site.
2.0% of monoethanolamine
1.66% of sodium ion
2.65% of potassium ion
7.25% of propylene glycol
7.75% of ethanol 0.66% of formic acid
0.13% of the compound of formula 1*a*
Balance to 100% of minors and water.

EXAMPLE 2

A composition is formulated comprising:

| | |
|---|---|
| $C_{11-18}$ linear alkyl benzene sulphonic acid | 11% |
| $C_{14-15}$ alcohol polyethoxylate 7 EO | 12% |
| Topped whole cut coconut fatty acid Chain length mixture; $C_{10}$ (5%), $C_{12}$ (55%), $C_{14}$ (22%), $C_{18}$ (2%), Oleic acid (10%) | 20.5% |
| $C_{10-11}$ isoparaffins | 4% |
| Diethyl phthalate | 6% |
| Cyclohexylamine | 2% |
| Monomethyl ethanolamine | 4.3% |
| Potassium citrate monohydrate (63.5% in water) | 2.4% |
| Dequest 2060 S | 1.7% |
| Tetraethylene pentamine ethoxylated with 15-18 moles of ethylene oxide | 1.5% |
| Ethanol | 3% |
| Potassium hydroxide (50% in water) | 3% |
| Formic acid | 0.2% |
| $CaCl_2$ $2H_2O$ | 0.05% |
| The compound of formula 1a | 0.18% |
| Marcatase enzyme | 0.71% |
| Termarnyl 300L enzyme | 0.10% |
| Water, perfume etc. | Balance |

EXAMPLE 3

A composition is formulated comprising:

| | |
|---|---|
| $C_{12}$ linear alkylbenzene sulphonic acid | 10.2% |
| Triethanolamine coconut alkyl sulphate | 3.9% |
| $C_{13-15}$ alcohol polyethoxylate (7 EO) | 11.7% |
| Topped whole cut coconut fatty acid | 10.7% |
| Oleic acid | 3.9% |
| Citric acid (anhydrous) | 0.9% |
| Diethylenetriamine pentamethylene-phosphoric acid | 0.85% |
| Triethanolamine | 4.4% |
| Sodium hydroxide | 3.0% |
| Propylene glycol | 2.8% |
| Ethanol | 5.8% |
| Sodium formate | 1.0% |
| Brightener of formula 1a (of Example 1) | 0.18% |
| Minors + Water | Balance to 100% |

This composition can be used directly as a liquid detergent in an aqueous laundry bath at 100 ml/10 liters.

EXAMPLES 4 and 5

Example 1, 2 or 3 is repeated using instead of the compound of formula 1*a* an appropriate amount of one of the following compounds:

The compound of formula 4*a*

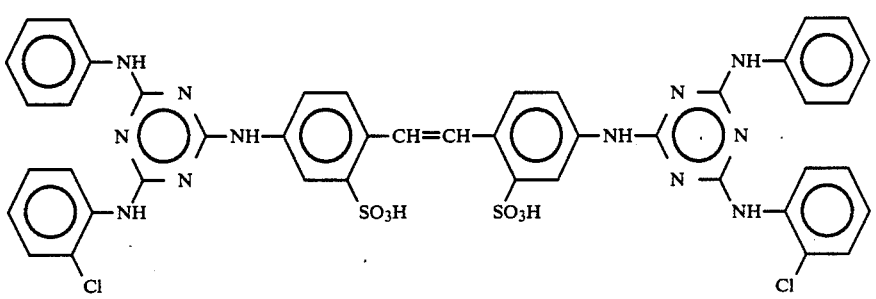

(4a)

The compound of formula 5*a*

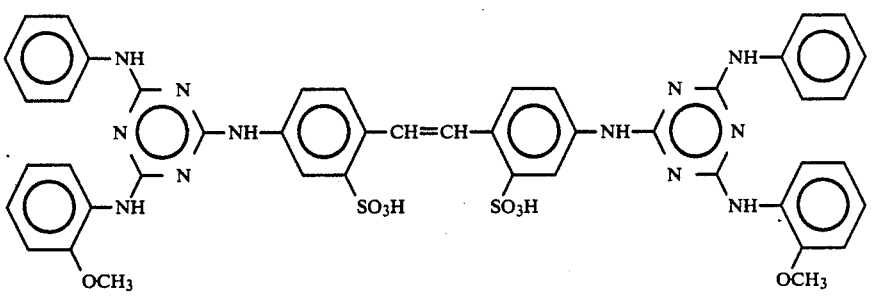

(5a)

The compositions of Examples 1 or 2 can be directly used as liquid detergents in an aqueous laundry bath at 100 ml/10 liters.

EXAMPLES 6 to 19

Compounds of the formula

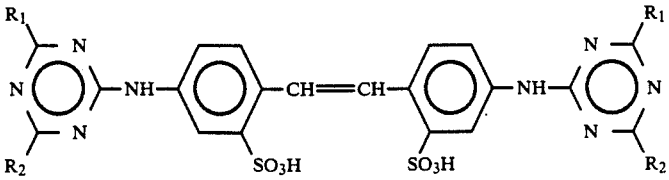

where $R_1$ and $R_2$ are defined in the Table below, can be added to a composition according to Example 1, 2 or 3.

TABLE

| EX. No. | $R_1$ | $R_2$ |
|---|---|---|
| 6 | 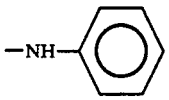 | 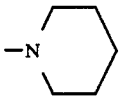 |
| 7 | 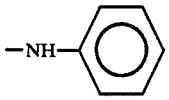 | 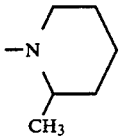 |
| 8 | 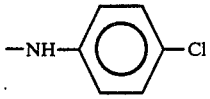 | 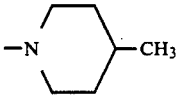 |
| 9 | 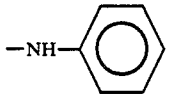 | 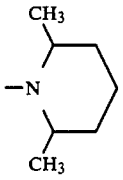 |
| 10 | 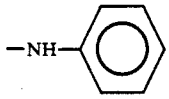 | 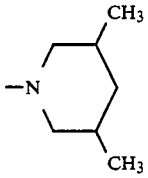 |
| 11 | 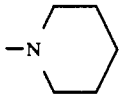 | 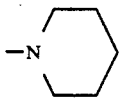 |
| 12 | 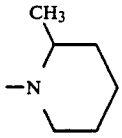 | 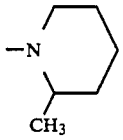 |
| 13 | 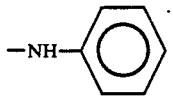 | 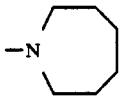 (hexamethyleneimino) |
| 14 | 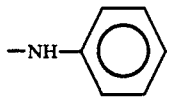 | 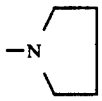 |
| 15 | 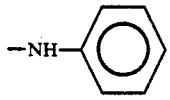 | 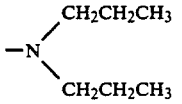 |
| 16 | 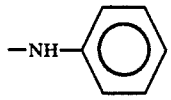 | $-NH-CH_2CH_2CH_3$ |

TABLE-continued

| EX. No. | $R_1$ | $R_2$ |
|---|---|---|
| 17 | 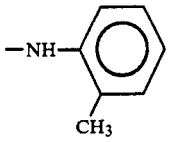 | 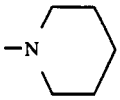 |
| 18 | $-NHCH_3$ | 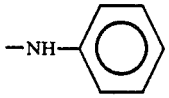 |
| 19 | $-NHC_2$ | 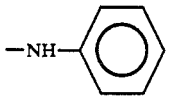 |

What is claimed is:

1. An aqueous, isotropic liquid detergent composition comprising an aqueous solution of (a) an anionic surfactant and (b) and optical brightener of formula I

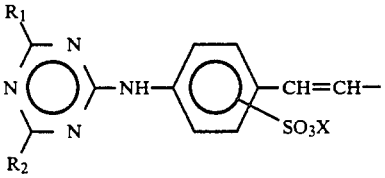

(I)

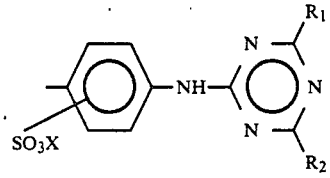

in which X is hydrogen, $NH_4^+$, or a cation of an alkali metal, an alkaline earth metal or an organic amine and $R_1$ and $R_2$, independently, are selected from morpholino and anilino unsubstituted or substituted by 1, 2 or 3 groups selected from $C_{1-4}$alkyl, $C_{1-4}$alkoxy and halogen; piperidinyl, unsubstituted or substituted by 1 or 2 $C_{1-4}$alkyl groups; hexamethyleneimino; pyrrolidino; $C_{1-8}$alkylamino; $C_{1-8}$-dialkylamino; and a 2,2,6,6-tetramethylpiperidinyl residue; provided that at least one $R_1$ is unsubstituted piperidinyl.

2. A detergent composition according to claim 1, in which, in the compound of formula I, $R_1$ is $R_1'$ is anilino, unsubstituted or monosubstituted by $C_{1-4}$alkyl; piperidinyl, unsubstituted or substituted by 1 or 2 $C_{1-4}$alkyl groups; hexamethyleneimino; pyrrolidino; propylamino or dipropylamino.

3. A detergent composition according to claim 1, in which, in the compound of formula I, both groups $R_1$ are piperidinyl, unsubstituted or substituted by 1 or 2 methyl and the groups $R_2$ are either both unsubstituted anilino or both o-toluidinyl.

4. A detergent composition according to claim 1, containing one or more of the following:

(a) an enzyme (b) a sequestrant for metal ions;

(c) an ethoxylated amine as a performance booster;
(d) a non-ionic, cationic, zwitterionic or ampholytic surfactant;
(e) a builder;
(f) a fatty acid.

5. An aqueous detergent composition according to claim 1, containing one or more of the following:
(a) 2 to 60% by weight of anionic surfactant
(b) 0.05 to 1.5% by weight of the compound of formula I;
(c) 0.05 to 2% by weight of enzyme;
(d) 0.1 to 3% by weight of sequestrant;
(e) 0.5 to 2% by weight of ethoxylated tetraethylene pentamine as a performance booster;
(f) 0.5 to 20% by weight of non-ionic, cationic, zwitterionic or ampholytic surfactants;
(g) 0.5 to 2% builders;
(h) 5 to 20% fatty acid, and
(i) the balance being water provided the total amount of surfactant is no more than 60%.

6. A composition according to claim 1 wherein both groups $R_1$ are the same.

7. A composition according to claim 1 wherein $R_2$ is $R_2'$ where $R_2'$ is anilino, unsubstituted or substituted by 1 or 2 groups selected from $C_{1-4}$alkyl, halogen and $C_{1-4}$alkoxy.

8. A composition according to claim 6 wherein $R_2$ is $R_2'$ where $R_2'$ is anilino, unsubstituted or substituted by 1 or 2 groups selected from $C_{1-4}$alkyl, halogen and $C_{1-4}$alkoxy.

9. A composition according to claim 3 containing 2 to 60%, by weight, of anionic surfactant and 0.05 to 1.5%, by weight, of compound of formula I.

10. A composition according to claim 1 containing 2 to 60%, by weight, of anionic surfactant and 0.05 to 1.5%, by weight, of compound of formula I.

11. A composition according to claim 6 containing 2 to 60%, by weight, of anionic surfactant and 0.05 to 1.5%, by weight, of compound of formula I.

12. A composition according to claim 7 containing 2 to 60%, by weight, of anionic surfactant and 0.05 to 1.5%, by weight, of compound of formula I.

13. A composition according to claim 8 containing 2 to 60%, by weight, of anionic surfactant and 0.05 to 1.5%, by weight, of compound of formula I.

14. A composition according to claim 3 wherein the anionic surfactant is selected from the group consisting of $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation; $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-$(C_2H_5—O—)_{1-4}$ ether sulphates; $C_{10-20}$alkyl $(C_2H_5—O—)_{1-4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

15. A composition according to claim 1 wherein the anionic surfactant is selected from the group consisting of $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation; $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-$(C_2H_5—O—)_{1-4}$ ether sulphates; $C_{10-20}$alkyl $(C_2H_5—O—)_{1-4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

16. A composition according to claim 6 wherein the anionic surfactant is selected from the group consisting of $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation; $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-$(C_2H_5—O—)_{1-4}$ ether sulphates; $C_{10-20}$alkyl $(C_2H_5—O—)_{1-4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

17. A composition according to claim 7 wherein the anionic surfactant is selected from the group consisting of $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation; $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-$(C_2H_5—O—)_{1-4}$ ether sulphates; $C_{10-20}$alkyl $(C_2H_5—O—)_{1-4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

18. A composition according to claim 8 wherein the anionic surfactant is selected from the group consisting of $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation; $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-$(C_2H_5—O—)_{1-4}$ ether sulphates; $C_{10-20}$alkyl $(C_2H_5—O—)_{1-4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

19. A composition according to claim 9 wherein the anionic surfactant is selected from the group consisting of $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation; $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-$(C_2H_5—O—)_{1-4}$ ether sulphates; $C_{10-20}$alkyl $(C_2H_5—O—)_{1-4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

20. A composition according to claim 11 wherein the anionic surfactant is selected from the group consisting of $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation; $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-$(C_2H_5—O—)_{1-4}$ ether sulphates; $C_{10-20}$alkyl $(C_2H_5—O—)_{1-4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

21. A composition according to claim 13 wherein the anionic surfactant is selected from the group consisting of $C_{2-4}$alkoxysulphates of $C_{8-22}$alcohols; $C_{9-22}$alkyl benzene sulphonic acids and salts thereof; $R_{20}$-$SO_3$-M, where $R_{20}$ is a $C_{12-22}$alkyl group and M is hydrogen or an alkali metal cation; $C_{10-18}$alkyl sulphates containing 0 to 4 ethyleneoxide units per mole of alkyl sulphate; water soluble salts of $C_{8-24}$alkyl sulphonates; $C_{8-18}$alcohol ether sulphonates; $C_{8-12}$alkyl phenol-$(C_2H_5—O—)_{1-4}$ ether sulphates; $C_{10-20}$alkyl $(C_2H_5—O—)_{1-4}$ ether sulphates; water soluble salts of $C_{1-10}$esters of alpha-sulphonates of $C_{6-22}$ fatty acids; water soluble salts of 2-$C_{2-9}$acyloxy-$C_{9-23}$alkane-1-sulphonic acids; water soluble salts of $C_{12-14}$alkenyl sulphonates and beta-$C_{1-3}$alkoxy$C_{8-20}$alkane sulphonates.

22. A composition according to claim 1 wherein, in the compound of formula I, both groups $SO_3X$ are in the 2-position with respect to the —CH=CH— group.

23. A composition according to claim 1 wherein any piperidinyl group as $R_1$ or $R_2$ is attached to the triazine group through the heterocyclic N-atom.

24. A composition according to claim 22 wherein any piperidinyl group as $R_1$ or $R_2$ is attached to the triazine group through the heterocyclic N-atom.

25. A composition according to claim 21 wherein, in the compound of formula I, both groups $SO_3X$ are in the 2-position with respect to the —CH=CH— groups and any piperidinyl group as $R_1$ is attached to the triazine group through the heterocyclic N-atom.

26. A composition according to claim 8 wherein the compound of formula I is a compound of the formula

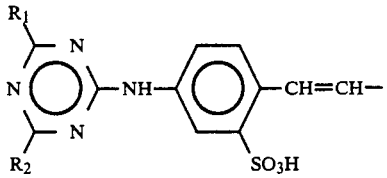

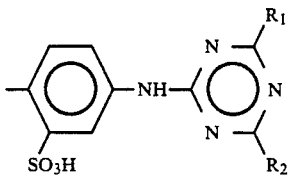

wherein both groups $R_1$ are of the formula

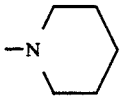

and both groups $R_2$ are the same as $R_1$ or are unsubstituted anilino or 2-methylanilino.

27. A composition according to claim 26 wherein both groups $R_2$ are unsubstituted anilino.

* * * * *